United States Patent [19]

Paque et al.

[11] 4,402,619

[45] Sep. 6, 1983

[54] PRINTING APPARATUS AND PRINTING CARTRIDGE THEREFOR

[75] Inventors: Michael W. Paque, Stillwater; Franklin C. Bradshaw, St. Paul, both of Minn.

[73] Assignee: Kroy, Inc., St. Paul, Minn.

[21] Appl. No.: 248,956

[22] Filed: Mar. 30, 1981

[51] Int. Cl.[3] ..... B41J 3/30; B41J 15/04

[52] U.S. Cl. ..... 400/36; 400/48; 400/208; 400/613; 400/615.2

[58] Field of Search ..... 400/36, 48, 238, 613, 400/615.2, 617, 618, 654, 655, 208, 194–196.1; 242/55.17–55.19

[56] References Cited

U.S. PATENT DOCUMENTS

| | | | |
|---|---|---|---|
| 3,643,777 | 2/1972 | Anderson et al. | 400/208 |
| 3,750,791 | 8/1973 | McReynolds et al. | 400/134 |
| 3,980,171 | 9/1976 | Frechette | 400/208 |
| 4,015,700 | 4/1977 | Paque | 400/617 |
| 4,226,547 | 10/1980 | Bradshaw et al. | 400/613 |
| 4,239,399 | 12/1980 | Johnstun | 400/613 |
| 4,243,333 | 1/1981 | Bradshaw et al. | 400/613 |

*Primary Examiner*—Paul T. Sewell

*Attorney, Agent, or Firm*—Dorsey & Whitney

[57] ABSTRACT

An improved printing apparatus and tape-ribbon cartridge for use in a dry lettering printing process. The printing apparatus includes a printing station, a mechanism for generating a printing force at the printing station, a rotatable font element having a plurality of raised characters on its underside, an improved mechanism, in cooperation with the printing cartridge, for advancing the tape and ribbon into printing alignment with the printing station and means for aligning the printing font. The printing cartridge includes a cartridge housing, a supply of tape and ribbon within the cartridge and a reciprocally movable shuttle assembly for advancing the tape and ribbon toward the printing station. The cartridge also includes a mechanism for rewinding used ribbon onto a rewind spool within the cartridge.

43 Claims, 19 Drawing Figures

109
105
13
113
168
122
134
135
131
132
145
146
129
128
133
160
162
139
164b
167
161
165
164a
156
123
153
157
136
138
165
126
125
124
149
150
117
119
121
110
127
140
142
130
139

PRINTING APPARATUS AND PRINTING CARTRIDGE THEREFOR

BACKGROUND OF THE INVENTION

The present invention relates generally to an improved printing apparatus or composing system and a printing cartridge for use therewith. More particularly, the present invention relates to an improved printing apparatus and cartridge of the type involving the use of a pressure process to transfer dry carbon impressions from a printing ribbon onto an image carrying tape. The apparatus of the present invention includes a printing station, a printing force generating means, a typedisc or font element with a raised character positionable in printing alignment with the printing station and means for advancing and properly spacing the tape and ribbon with respect to the printing station. The printing cartridge of the present invention includes a supply of printing tape and ribbon, means within the cartridge for supplying the tape and ribbon at the printing station and means for rewinding printing ribbon after the same has been used.

In the dry lettering printing process of the type utilized by the present invention, a high pressure is utilized to transfer dry carbon or other ink or color material from a ribbon onto an image carrying tape. A typical process may require pressures as high as 5000–6000 p.s.i. or higher. A typedisc or font element having raised portions corresponding to particular images desired to be printed is commonly used in such a process. Typical prior art machines and apparatus utilizing dry lettering processes are shown and described in U.S. Pat. Nos. 3,834,507; 3,912,064; 4,015,700; 4,226,547 and 4,243,333.

SUMMARY OF THE INVENTION

The present invention relates to improvements in a dry lettering printing apparatus and a tape-ribbon cartridge for use therewith. More specifically, the printing apparatus includes improved means, in cooperation with an improved printing cartridge, for advancing the tape and ribbon into printing alignment with the printing station and means for ensuring proper spacing between adjacent characters. The apparatus also includes a means for generating a printing force at the printing station including an improved print bar assembly having one end pivotally connected to a portion of the apparatus frame and having its other end moved with respect to such pivot by an improved toggle link assembly. Means are also provided for adjusting the amount of printing force generated by the print bar assembly.

The printing cartridge adapted for use with the apparatus of the present invention includes a cartridge housing, a supply of printing tape and printing ribbon disposed between side walls of the housing and a reciprocally movable shuttle assembly positioned between the side walls of the housing for advancing the tape and ribbon into alignment with the print station. In the preferred embodiment, this tape and ribbon advance means includes a pair of leaf spring clutch assemblies which allow for forward movement of the tape relative to the cartridge housing and the shuttle assembly. One clutch assembly, however, precludes movement of the tape in a rearward direction relative to the cartridge housing while the other clutch assembly precludes rearward movement of the tape relative to the shuttle assembly. The cartridge also includes means for reversing the direction of the ribbon after the same has been utilized in a printing cycle and guiding the ribbon back to the print cartridge to be rewound on a rewind spool.

Accordingly, an object of the present invention is to provide an improved dry lettering printing apparatus of the type utilizing a dry lettering process with improved means for generating a print force and for advancing the printing tape and ribbon toward the printing station.

A further object of the present invention is to provide an improved printing cartridge for use with the printing apparatus of the present invention.

Another object of the present invention is to provide a printing cartridge adapted for insertion into a printing apparatus in fixed relationship relative to the apparatus frame and including improved means for advancing the tape and ribbon supply toward the printing station.

Another object of the present invention is to provide a printing cartridge with a reciprocally movable shuttle assembly for advancing the tape and ribbon and for rewinding used ribbon onto a rewind spool.

These and other objects of the present invention will become apparent with reference to the drawings, the description of the preferred embodiment and the appended claims.

DESCRIPTION OF THE PREFERRED EMBODIMENT

Figure 1:
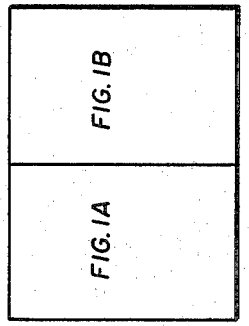
FIG. 1, comprised of FIGS. 1A and 1B, is an exploded pictorial view of the printing apparatus of the present invention showing the font element and the printing cartridge.

Reference is first made to FIG. 1 showing an exploded pictorial view of the printing apparatus and tape-ribbon cartridge of the present invention. In general, the apparatus of the present invention includes a print bar assembly 10 disposed between a pair of spaced, parallel frame plates 11 and 12, a drive assembly 14 including a motor 15 and a gear assembly, a printing cartridge 16 containing a supply of printing tape and ribbon and a lettering font 13.

As will be described in greater detail below, printing tape 130 and ribbon 131 is supplied from the cartridge 16 into printing alignment with a printing station defined by a pair of print pads and the aligned position of a character located on the bottom surface of the lettering font 13. During the printing cycle, printing pressure is provided to the printing station by the print bar assembly 10 to transfer an image of the aligned character from the printing ribbon 131 to the printing tape 130. Means are also provided for then appropriately advancing the tape and ribbon into alignment for printing the next character.

The support frame plates 11 and 12 are generally flat plate members which are secured together in spaced relationship from one another by a plurality of spacing bushings 18. Each of the frame plates 11 and 12 includes an open section 19 and 20, respectively, to define in part the printing station and to accommodate the printing pad, font alignment and tape cut off features of the print bar assembly 10 as will be further described below. The print bar assembly 10 includes a pair of print bars 21 and 22 which are disposed in spaced, parallel relationship with one another between the frame plates 11 and 12. The forward end of each of the print bars 21 and 22 includes an upwardly extending tab portion 24, 24 with an opening therethrough for pivotal connection with respect to the frame plates 11 and 12. A bushing 26 is positioned between the tabs 24 to provide proper spacing between the print bars 21 and 22. The print bars 21 and 22 are secured in pivotal relationship between the frame plates 11 and 12 about the pivot point defined by the fastener 25. The fastener can include a rivet or screw or the like and is adapted to extend through the tabs 24 and the bushing 26. The rearward end of each of the print bars 21 and 22 also includes a tab portion 28. One of these tabs 28 is disposed on either side of one end of a movable link member 29 at the pivot point 32. The link 29 is part of a toggle mechanism which comprises the movable link 29, a crank link 30 and a fixed link 31 for providing printing force movement to the print bar assembly. The crank link 30 has one end connected to and movable with an eccentric pin 39 on the gear member 40 and its other end pivotally connected with the fixed link 31 at a point 35 intermediate between its ends. The fixed link 31 has one end pivotally secured with respect to the frame plates 11 and 12 at the point 38 and its other end pivotally secured to the movable link 29 at the point 34. As will be described more specifically with respect to the operation of the printing apparatus, the toggle mechanism causes upward pivotal movement of the print bar assembly 10 about the pivot axis of the fastener 25 to generate the printing force.

Figure 2:
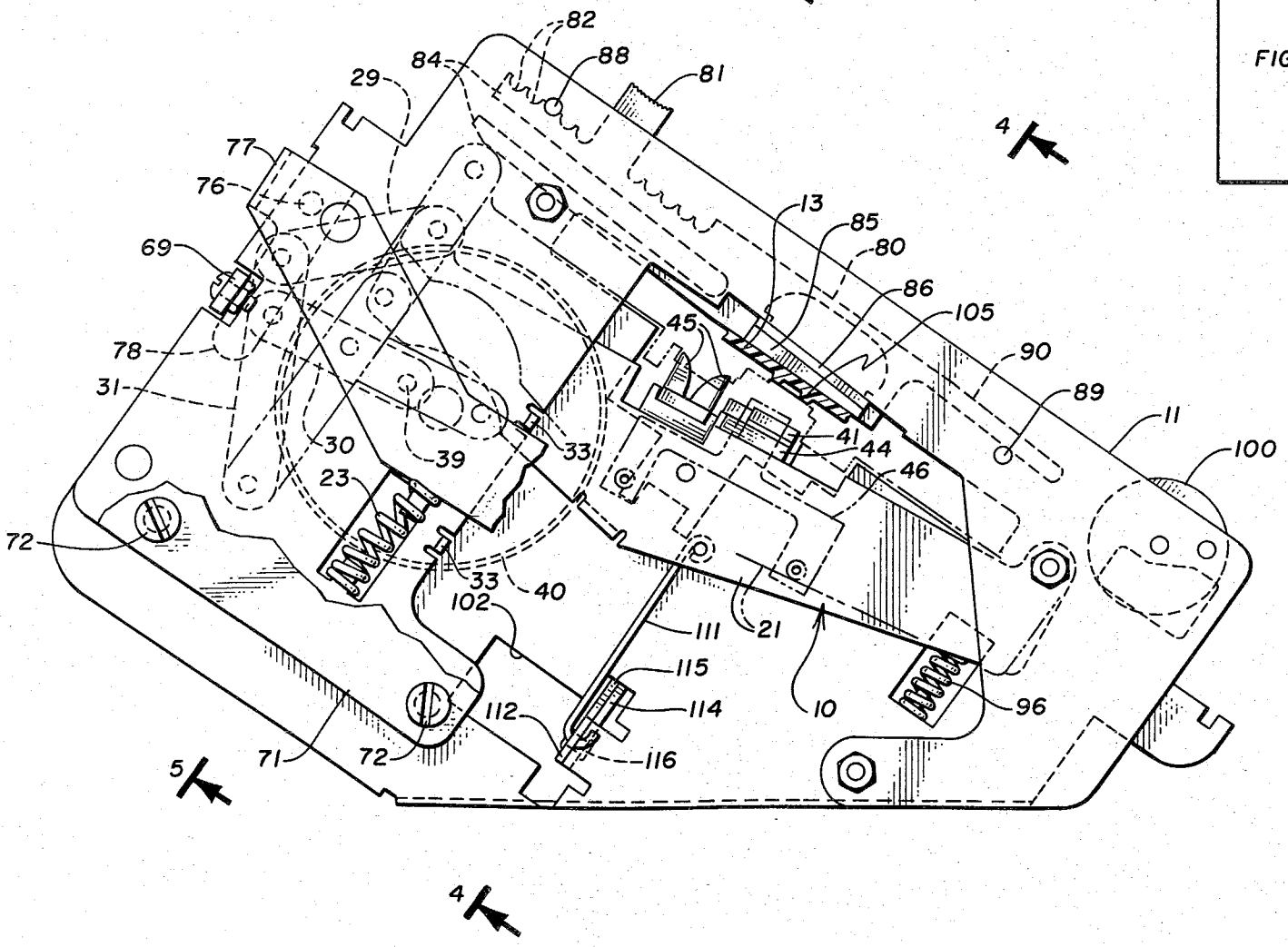
FIG. 2 is an elevated side view of one side of the printing apparatus of the present invention.
Figure 1A:
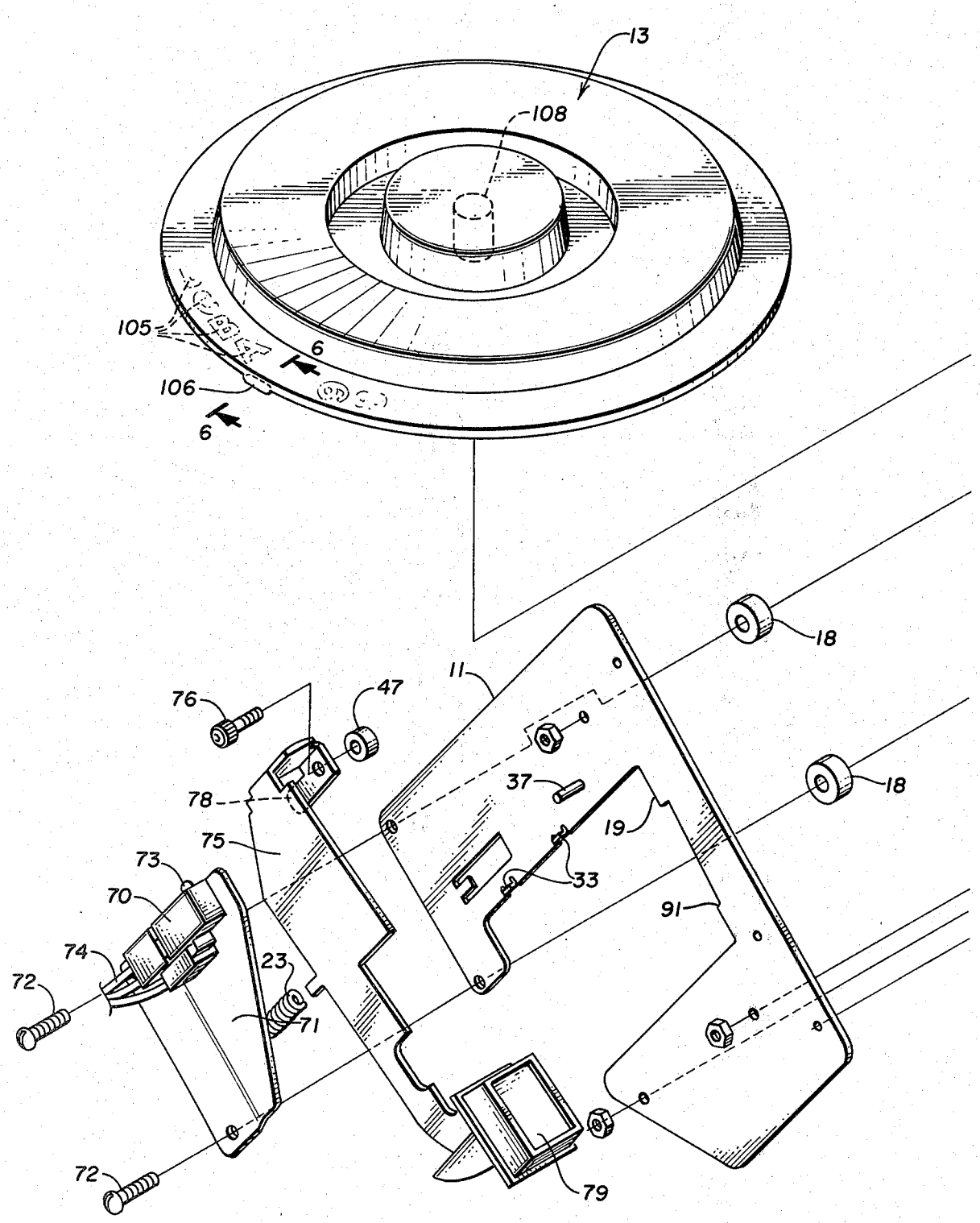
Figure 1B:
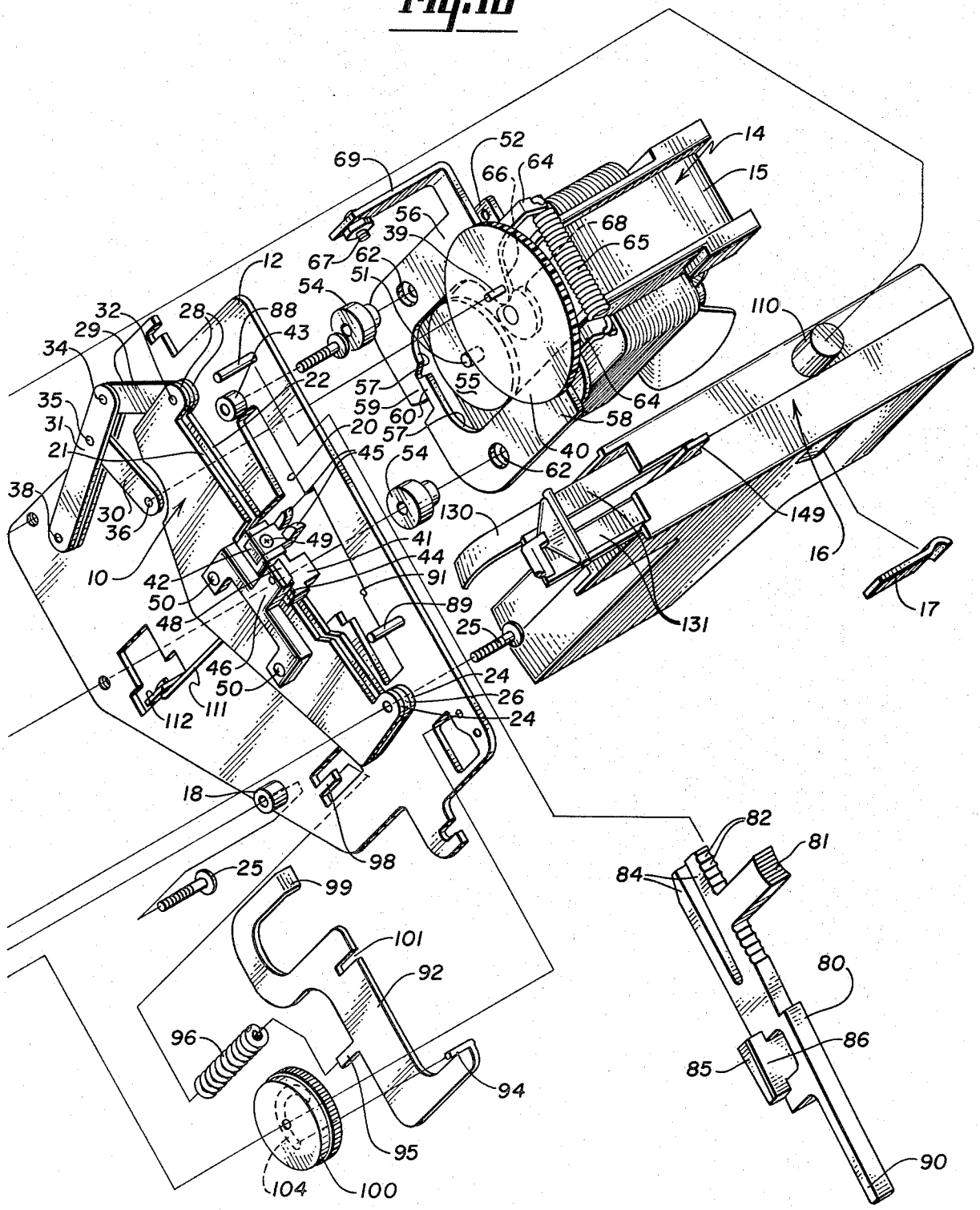
Figure 3:
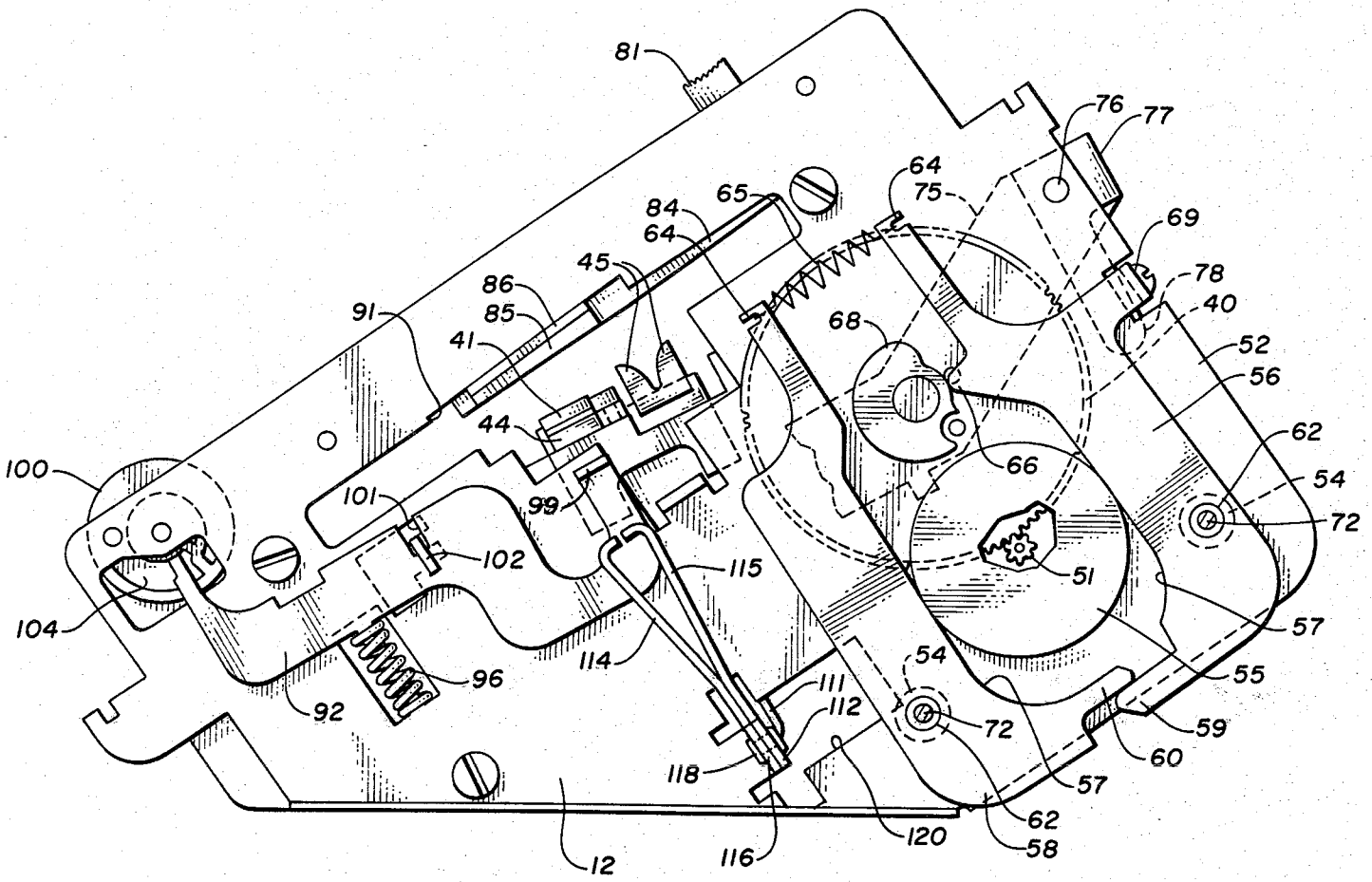
FIG. 3 is an elevated side view of the other side of the printing apparatus as viewed without the printing cartridge and printing font and without the printing motor and gear housing.
Figures 4, 12, 13, 14:
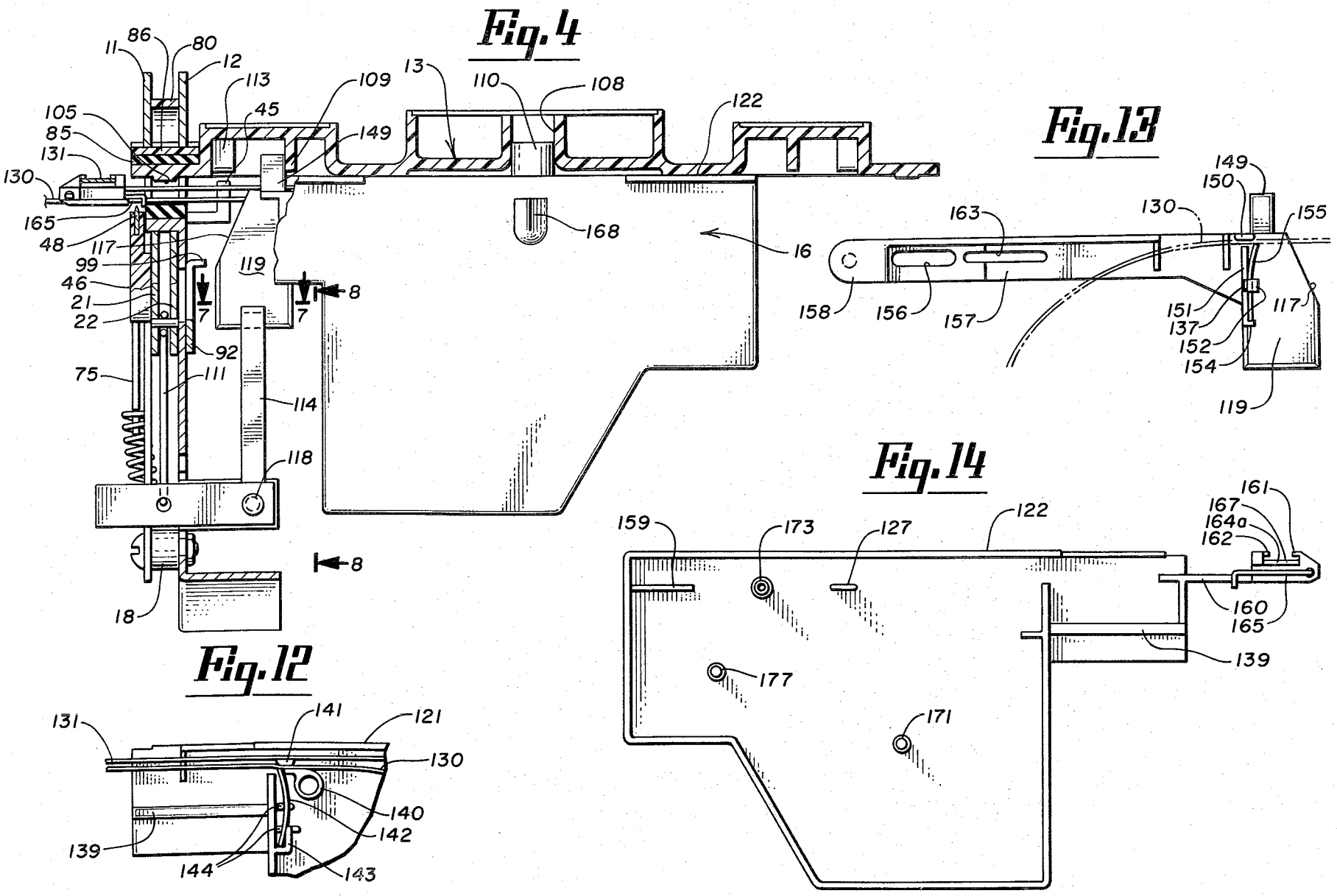
FIG. 4 is a view, partially in section, as viewed along the section line 4—4 of FIG. 2.
FIG. 12 is an elevated view of a portion of one of the cartridge housing sections showing one of the leaf spring clutch assemblies.
FIG. 13 is an elevated view of one side of the shuttle assembly showing the other leaf spring clutch assembly.
FIG. 14 is an elevated view showing the inside of one of the cartridge housing sections and the tape-ribbon guide means.

As illustrated generally in FIG. 1 and more specifically in FIGS. 2, 3 and 4, the print bar assembly 10 includes a lower print pad 41, a font alignment member 42 and a tape cutting bracket 46. Both the lower print pad 41 and the font alignment member 42 are mounted to the print bars 21 and 22 via the printing pad support bracket 44. The support bracket 44 in turn is secured in fixed relationship between the print bars 21 and 22. In the preferred embodiments, the lower print pad 41 is made from a urethane material and is secured to the support bracket 44 by a plurality of channel grooves and ribs and an adhesive or by other conventional means. The font alignment bracket 42 is connected to the support bracket 44 by the screw 49 and includes a pair of upwardly extending alignment tabs 45, 45, each of which includes an internally rounded or beveled surface which is inclined downwardly and inwardly toward the other. As will be described in more detail below, the rounded or beveled surfaces of the tabs 45, 45 engage opposite sides of an alignment rib or tab 113 (FIGS. 4 and 9) on the underside of the printing font 13 to rotate the font into printing alignment with the printing station.

The tape cutting bracket 46 is secured to the outer surface of the print bar 21 by a pair of screws 50 and includes an upwardly extending portion. A blade 48 with an upwardly disposed cutting edge is connected with this portion to sever the tape 130 when the font element 13 is rotated to a position in which the peripheral raised portion 106 (FIGS. 1 and 6) is in vertical alignment above the blade 48. When this occurs, upward movement of the print bar assembly 10 causes movement of the blade 48 toward the portion 106 with the tape 130 and guide member 165 (FIG. 10) disposed therebetween, thus severing the tape.

The drive mechanism 14 includes the motor 15 and the associated gear members 51 and 40. As best understood with reference to FIGS. 1, 3 and 5, the gear member 51 is connected with the output shaft from the motor 15 and includes gear teeth for engagement with the teeth of the large gear member 40. The gear 40 is rotatably mounted between the outer surface of the frame plate 12 and the inner surface of a motor mounting bracket or plate 52. The plate 52 is mounted in spaced relationship with respect to the frame plate 12 and is retained in this position by the plurality of spacer bushings 54. The large gear member 40 includes an eccentric pin 39 extending toward the print bar assembly 10 for engagement with one end of the crank link 30. Thus, as the gear 40 rotates, the eccentric pin 39 causes translational movement of one end of the crank link 30 and corresponding upward movement of the print bar assembly 10.

The drive mechanism also includes a means for braking or stopping the inertial rotation of the motor shaft. This braking mechanism includes a circular disc 55 and a pair of brake jaws 56 and 58 each being supported for limited rotation between the frame plate 12 and the motor mounting bracket 52. This rotational support is accomplished by the holes 62, 62 in the break jaws 56 and 58 and the reduced diameter portion of the bushings 54. The disc 55 lies on the same rotational axis as the gear 51 and in the preferred embodiment is constructed of Nylon. The braking force provided by the jaw members 56 and 58 is caused by frictional engagement between the inner surfaces 57, 57 of the jaw members and the outer peripheral edge of the disc 55. The braking surfaces 57, 57 are urged into contact with the edge of the disc 55 by the force of the spring member 65 acting on upwardly extending arms 64, 64 of the brake jaws 56 and 58. This braking force is released by rotating the jaw members 56 and 58 in a direction extending the spring member 65. When this movement occurs, the jaw members 56, 58 pivot outwardly about the pivot points 62 and 62 as viewed in FIG. 3 thereby disengaging the edges 57, 57 from the disc 55.

Each of the brake jaws 56 and 58 includes a lower end portion 59 and 60, respectively, adapted for engagement with each other. The construction of these end portions is such that pivotable movement of the jaw 56 in a clockwise direction about the pivot 62 (as viewed in FIG. 3) will result in upward movement of the end 59 and thus similar upward movement of the end 60. This upward movement of the end 60 results in counterclockwise movement of the jaw 58 about its pivot 62 (as viewed in FIG. 3). Thus, pivotal movement of the jaw 56 to release braking engagement will result in corresponding release of the brake jaw 58 as well.

Connected with the brake jaw 56 is an outwardly extending arm 69 which, as will be discussed below, is adapted for engagement with a portion of the print lever for rotation into a non-braking position when the print lever is depressed. The jaw 56 also includes an ear portion 66 adapted for engagement with an eccentric cam member 68 associated with the gear 40. As illustrated best in FIGS. 1 and 3, the cam member 68 includes an indented or recessed portion which allows the ear 66, and thus the brake jaws 56 and 58 to move into a braking position with the surfaces 57, 57 engaged with the disc 55. As the gear 40 rotates, however, the outer edge of the cam member 68 engages the ear 66 and moves the jaws 56 and 58 into a non-braking position.

Actuation of the drive motor 15 is controlled by the microswitch 70 mounted to a switch mounting plate 71. The plate 71 is mounted to the outside surface of the frame plate 11 by the threaded members 72. As shown, the upper portion of the mounting plate 71 is outwardly offset from the lower portion to allow the print lever 75 to be disposed between the upper portion of the plate 71 and the outer surface of the frame plate 11. An appropriate cord or other electrical connection 74 is provided between the switch 70 and the motor 15.

The print actuation lever 75 is an elongated element pivotally connected to the motor mounting plate 52 by the threaded member 76 and the spacer 47. The lever 75 includes an arm member 77 connected with the main body of the lever 75 and extending around the ends of the frame plates 11 and 12. A tab member 78 extends downwardly from the arm 77 and engages a portion of the arm 69 extending outwardly from the brake jaw 56. The outer end of the arm 69 includes a contact element 67 aligned with the on-off button 73 of the switch 70. When the apparatus is in its non-operative state, the button 73 is in a depressed or off position and retained in such position by the contact portion 67. The forward end of the print lever 75 includes a printing button 79 adapted for manual depression. When the print button 79 is depressed, the print lever 75 is pivoted downwardly about the member 76. This causes engagement between the lower tab 78 and the arm 69 resulting in outward movement of the arm 69, release of the switch button 73 and consequent actuation of a printing cycle. As shown in FIG. 2, Movement of the lever 75 is limited by the tabs 33, 33. The spring 23 biases the lever 75 toward its upper position.

As illustrated best in FIGS. 1 and 2, an upper print pad assembly comprising the elongated member 80 is disposed between the frame plates 11 and 12 and includes forward jaw portions 84, 84 vertically spaced from one another. The upper surface of the top jaw member 84 includes a plurality of transverse grooves 82 adapted for engagement with a transverse pin 88 extending at right angles between the plates 11 and 12. A depression tab portion 81 extends upwardly from the top jaw member 84 for manual depression of the upper jaw 84 and movement of the elongated member 80. Integrally joined with the member 80 is an upper print pad 85 having a lower print pad surface and portions extending horizontally outwardly from the member 80. In the preferred embodiment, the pad 85 is made from a material such as Delrin. A metal plate 86 is disposed on top of the print pad 85 for engagement with edges of the frames 11 and 12 to resist the print force generated by the print bar assembly 10. The member 80 also includes a thin end section 90 supported vertically by a pin 89. The pin 89 extends at right angles between the plates 11 and 12. When installed between the frame plates 11 and 12, the upper print pad assembly is supported by the pin 89 at the end 90 and by the spacing member 43 against the lower surface of the bottom jaw member 84. Upper movement of the print assembly 80 is prevented by engagement between the upper surfaces of the metal plate 86 and a lower edge of the cut-out portion of the frame plates 11 and 12.

As illustrated best in FIGS. 2 and 3, the upper print pad 85 varies in thickness from one end to the other relative to the path of longitudinal movement of the upper print pad assembly 80. As a result of this difference in thickness, the vertical position of the print pad surface of the print pad 85, and thus the vertical distance between this surface and the lower print pad 41 can be varied by moving the assembly 80 longitudinally between the frame plates 11 and 12. The assembly 80 is moved by depressing the tab member 81 to release engagement between the grooves 82 and the pin 88 and then moving the assembly 80 to the desired position. As this assembly 80 is moved toward the left as viewed in FIG. 2, the thickness of the upper print pad 85 (relative to a fixed print station) decreases. Thus, the vertical distance between the lower surface of the upper print pad 85 and the corresponding lower print pad 41 is slightly greater and the resulting print force is less. As the upper print pad assembly 80 is moved toward the right as viewed in FIG. 2, the upper print pad 85 relative to the fixed print station becomes thicker, thus decreasing the vertical distance between the upper and lower print pads and resulting in the generation of a greater printing force. In the preferred embodiment, the thickness of the pad 85 is such that its lower printing surface is disposed at an angle of about three degrees relative to the path of longitudinal movement of the assembly 80. Movement of the print pad assembly 80 toward the left as viewed in FIG. 2 is limited by interference between the metal plate 86 and corresponding shoulder portions 91, 91 in each of the frames 11 and 12.

The printing apparatus of the present invention also includes means for adjusting the general spacing betwen adjacent characters as they are printed during a print cycle. In the preferred embodiment, this means includes the spacing arm 92 and the thumb wheel 100. As illustrated best in FIGS. 1 and 3, the spacing arm 92 is disposed adjacent to the outer surface of the frame plate 12 and retained there in generally pivotal relationship as a result of engagement between the retaining tab 102 extending from the frame 12 and the notch 101 in the arm 92. A compression spring 96 is disposed between the post 95 extending downwardly from the spacing arm 92 and the post 98 extending upwardly from a portion of the frame plate 12. As a result of the force of the spring 96, engagement between the tab 102 and the notch 101 is maintained.

One end of the spacing arm 92 includes a tab portion 94 extendingg at right angles to the arm 92 and into engagement with a spriral shaped groove 104 disposed in one side of the spacing wheel 100. The wheel 100 is pivotally connected between the frame plates 11 and 12 by appropriate means. As the wheel 100 is manually rotated, the end tab 94 follows the contour of the spiral groove thereby causing limited pivotal movement of the spacing arm 92 about the point of contact between the tab 102 and the notch 101.

The other end of the spacing arm 92 includes a stop tab 99 extending at right angles to the arm 92 and toward the tape-ribbon cartridge 16. As the spacing arm 92 is pivoted, by virtue of the thumb wheel 100, the stop tab 99 moves upwardly and downwardly. As will be described in greater detail below with respect to the tape and ribbon advance mechanism of the cartridge 16, this tab 99 is adapted for engagement with a portion of the tape-ribbon cartridge shuttle tongue 119 to control the spacing between adjacent characters during a print cycle.

Figures 9, 10:
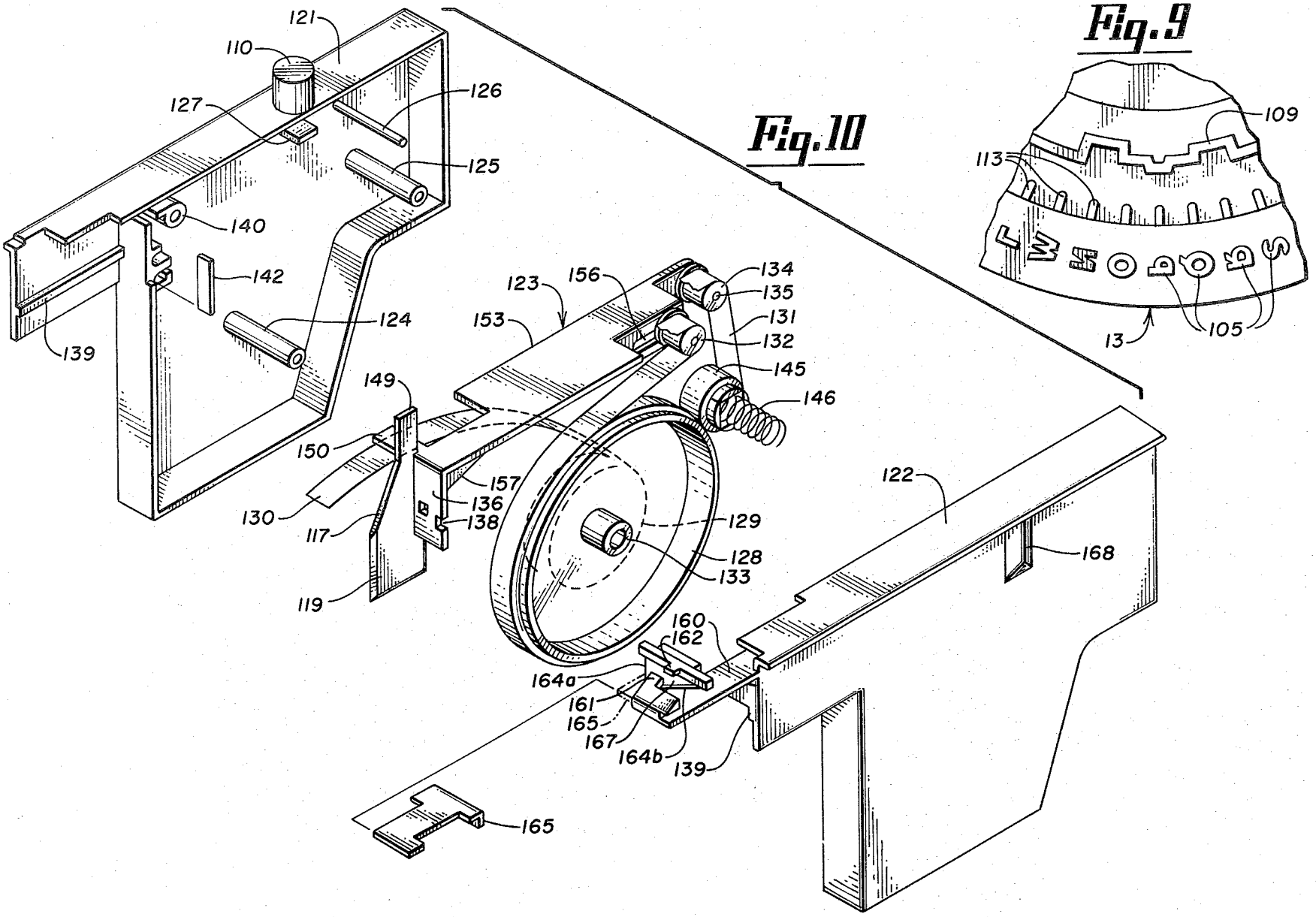
FIG. 9 is a detailed elevated view of a portion of the underside of the printing font.
FIG. 10 is an exploded pictorial view of the printing cartridge of the present invention.
Figure 11:
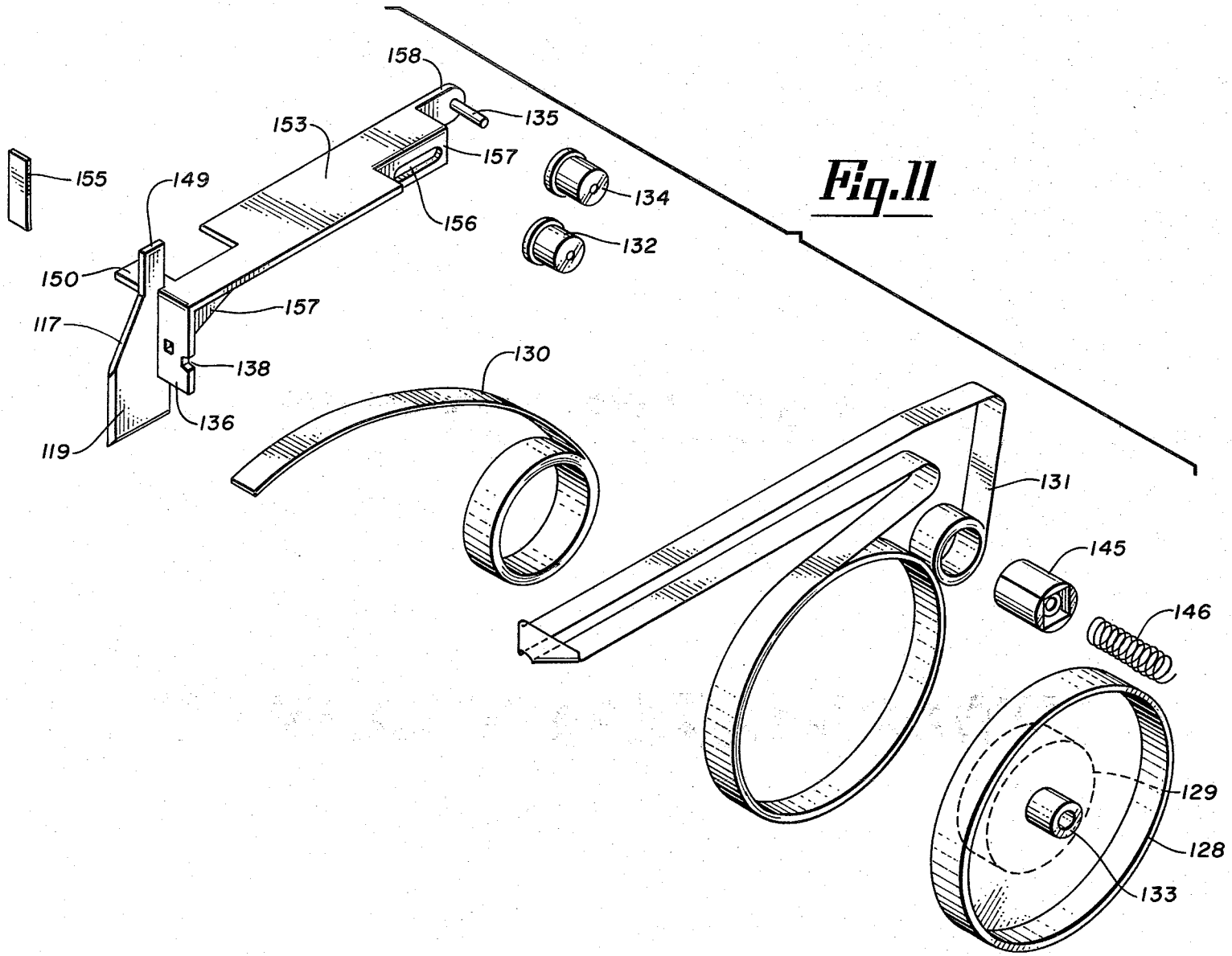
FIG. 11 is an exploded pictorial view of the shuttle assembly and the tape and ribbon movement within the cartridge of the present invention.

With reference to FIGS. 1, 4 and 9, the font 13 includes a plurality of raised letters and other characters 105 on the bottom surface of its peripheral edge. The underside of the font 13 also includes a plurality of circumferentially spaced alignment tabs 113 which are adapted for engagement by the two alignment arms 45 of the font indexing fork or alignment bracket 42. The underside of the font 13 also includes a plurality of letter spacing stop surfaces in the form of the letter spacing ring 109 which are engaged by a stop arm 149 of the tape-ribbon cartridge shuttle to control the advancement of printing tape and ribbon, and thus the specific spacing between adjacent letters, during a print cycle. The spacing control means comprised of the spacing arm 92 and the spacing control means comprised of the stop arm 149 and the spacing ring 109 are distinguished in that the former functions to control the amount of constant space between adjacent characters, while the latter functions to change the spacing to adjust for the particular width of the character just printed. For example, the character "I" will require less space than the character "W", etc. Thus, advancement of the tape and ribbon following printing of the "I" will be less than the advancement following the printing of a "W". The stop arm 149 and spacing ring 109 control this advancement. A centrally located hole 108 is disposed on the underside of the font 13 enabling it to be supported in free spinning relationship with respect to the font post 110 positioned on top of the tape-ribbon cartridge 16.

As described above the printing apparatus includes means for controlling or limiting the advancement of tape and ribbon during a print cycle. Means are also included for providing the tape-ribbon advancing movement. This means is illustrated best in FIGS. 3, 4, 7 and 8 and includes a shuttle gripping means comprising a pair of index arm gripping jaws 114 and 115 disposed on opposite sides of the shuttle tongue 119 when the cartridge is in its operative position within the apparatus. Each of the jaws 114 and 115 includes a gripping end adapted for engagement with opposite sides of the shuttle tongue 119 so that movement of the arms 114 and 115 results in corresponding limited movement of the tongue 119. The gripping ends are spaced from one another by a distance less than the thickness of the tongue 119. Thus, when the tongue 119 is inserted between the gripping ends, the gripping arms 114 and 115 which have some spring resiliency are forced apart. This results in the exertion of a gripping force by the gripping ends on the tongue 119. As shown best in FIG. 7, the edges of the gripping ends toward the cartridge 16 includes a beveled edge 97 to enable the tongue 119 to be easily inserted between the jaws 114 and 115. The leading edge of the tongue 119 is also beveled to facilitate this insertion.

Figures 5, 6, 7, 8, 15, 16, 17:
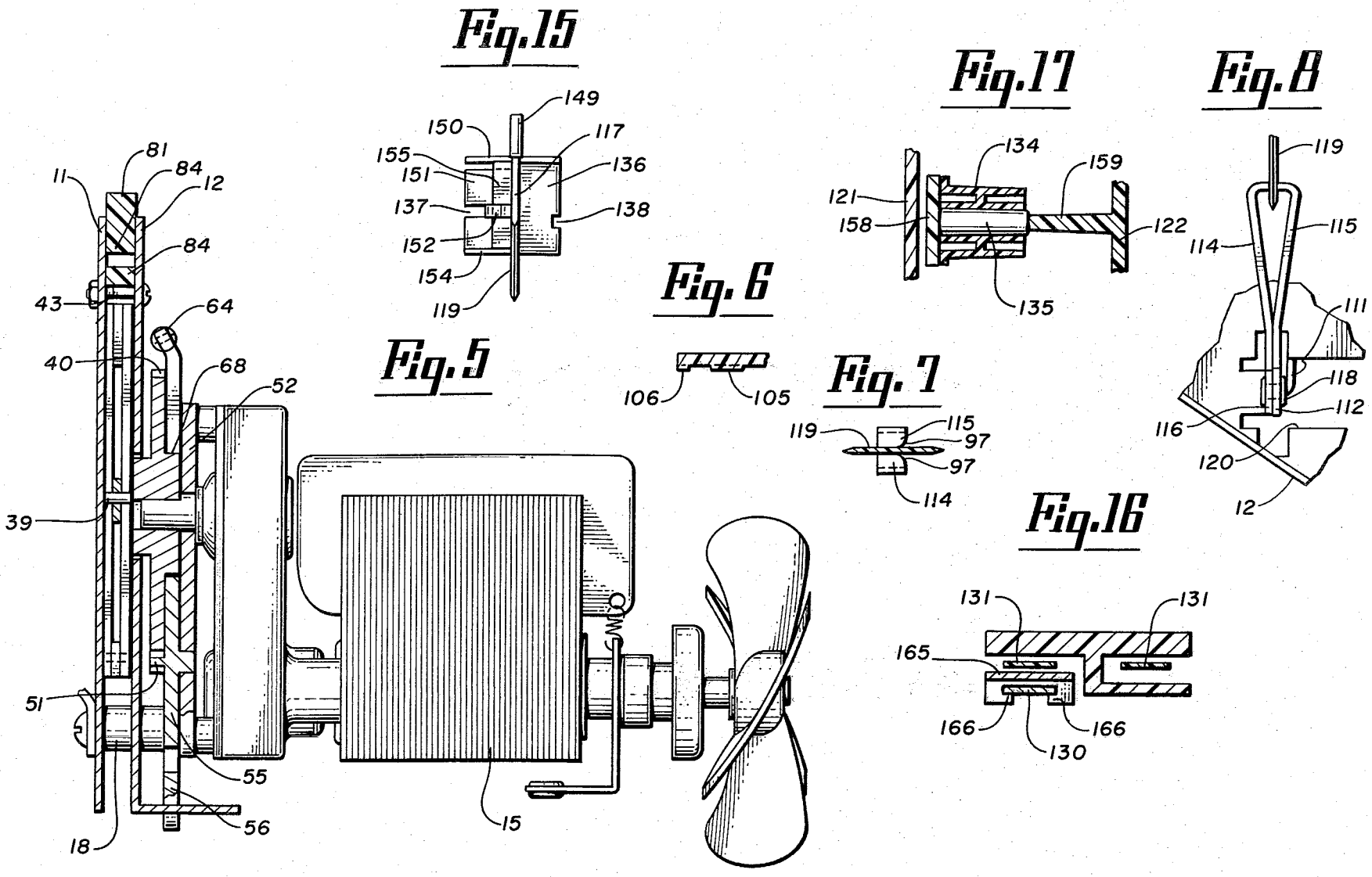
FIG. 5 is a view, partially in section, as viewed along the section line 5—5 of FIG. 2.
FIG. 6 is a sectional view of a portion of the outer peripheral edge of the printing font showing the cut-off tab as viewed along the section line 6—6 of FIG. 1A.
FIG. 7 is a sectional view of the means for gripping and reciprocally moving the shuttle assembly as viewed along the section line 7—7 of FIG. 4.
FIG. 8 is a sectional view as viewed along the section line 8—8 of FIG. 4 showing the means for gripping and reciprocally moving the shuttle assembly.
FIG. 15 is an elevated view of the forward end of the shuttle assembly of the printing cartridge.
FIG. 16 is a sectional view showing the tape and ribbon guide means.
FIG. 17 is a sectional view showing the ribbon roller and the means for retaining it in proper alignment.

As shown in FIGS. 3 and 8, the jaw member 115 is integrally connected in fixed relationship with one end of a transverse link 112 which extends through an opening 120 in the frame plate 12. The other end of the link 112 is connected with a portion of the print bar assembly 10 by the non-extendible wire member 111 (FIG. 1). In the preferred embodiment, the wire member 111 has one end connected through an opening in the link 112 and its other end connected with a pin member positioned between the print bars 21 and 22. The end of the link member 112 joined with the gripping arm 115 is pivotally connected to an outwardly extending tab 116 of the frame plate 12 by the pivot pin 118. With this structure, up and down movement of the print bar assembly 10, and thus the link 111, causes corresponding pivotal movement of the link 112 about the pivot 118 and thus generally translational movement of the gripping jaws 114 and 115 and their gripping ends. This movement results in corresponding rearward and forward movement of the shuttle tongue 119 and advancement of the tape and ribbon into printing alignment with the printing stations as will be described below.

Reference is next made to FIGS. 1 and 10–17 showing the tape-ribbon cartridge adapted for use with the printing apparatus of the present invention. In general, the tape-ribbon cartridge 16 comprises a cartridge housing, a supply of printing tape and printing ribbon and a means for advancing the tape and ribbon into printing alignment with the printing station.

As illustrated best in FIG. 10, the cartridge housing is comprised of a pair of housing half sections 121 and 122 which are adapted to be snapped, glued or otherwise secured together to house the tape and ribbon supply and the tape and ribbon advancement assembly. The section 121 includes an upstanding font post member 110 on its top surface for rotatably supporting the font element 13 (FIG. 1) for free spinning rotation. The interior of the section 121 includes a plurality of posts 124, 125 and 126 for rotatably supporting various of the rollers and spools for advancing the tape and ribbon as will be described below. As shown in FIG. 14, the interior of the section 122 includes a pair of short posts 171 and 177 for engagement with corresponding holes in the ends of the posts 124 and 125, respectively, and a boss 173 for engagement with the post 126 when the cartridge sections 121 and 122 are assembled. Each of the housing sections 121 and 122 also includes a shuttle guide rib 139, 139 at its forward end for guiding the shuttle assembly 123 in generally reciprocal movement back and forth along the direction of tape and ribbon advancement as will be described in greater detail below.

The printing tape 130 within the cartridge 16 is supplied from a tape supply spool 129 while the printing ribbon 131 is supplied from a ribbon supply spool 145. As illustrated best in FIGS. 10 and 11, the printing ribbon 131 is supplied from the spool 145 around the roller 134, around the forward guide portion or snout of the cartridge section 122, back around the roller 132 and onto the rewind spool 128. In the preferred embodiment, the tape spool 129 and the ribbon rewind spool 128 are connected with one another so that they rotate together in side-by-side relationship. Thus, as the tape 130 is supplied by rotation of the spool 129, the spool 128 rewinds used printing ribbon 131. In the preferred embodiment, the tape 130 includes an adhesive backed printing layer and a release backing while the ribbon 131 includes a ribbon with a carbon base surface which is transferred to the printing layer of the tape 130 as a result of exertion of a print force.

The shuttle assembly 123 is an elongated member mounted within the cartridge 16 and disposed between the cartridge housing sections 121 and 122 when assembled. As illustrated best in FIGS. 10, 11 and 13, the shuttle assembly 123 includes a relatively flat, horizontally disposed ribbon supporting surface 153 and a longitudinally extending rib section 157 disposed at right angles below the surface section 153 and approximately midway between the outer side surfaces of the sections 121 and 122. The rib 157 includes a pair of elongated openings 163 and 156. When assembled, the post 126 extends through the opening 156 to support the roller 132. Because the hole 156 is elongated, limited back and forth reciprocal movement of the shuttle assembly 123 is permitted relative to the post 126 and the roller 132. The opening 163 is designed to accommodate inwardly extending tabs 127, 127 from the inner surfaces of the sections 121 and 122 to assist in aligning and guiding the shuttle assembly 123 during its reciprocal movement.

At the forward end of the shuttle assembly 123 are a pair of end sections 136 and 151 disposed at right angles to the surface portion 153 and at right angles to the outer sides of the sections 121, 122 when assembled. Each of these forward sections 136 and 151 includes an alignment notch 138 and 137, respectively, for sliding engagement with the alignment ribs 139, 139 at the forward ends of the sections 121 and 122.

As illustrated in FIGS. 13 and 15, the shuttle assembly 123 includes means for permitting movement of the printing tape 130 in a forward direction relative to the shuttle 123, but preventing movement of tape 130 in a rearward direction relative to the shuttle 123. This means includes the wall section 150 lying generally on the same plane as the surface 153 and having its lower surface spaced slightly above the forward wall section 151 to allow for passage of the tape 130 therebetween. Positioned adjacent to and forward of a portion of the wall 151 is a post or tab 152 extending outwardly from the forward shuttle tongue member 119 to assist in retaining a leaf spring member 155 in the position illustrated. A lower shoulder portion 154 extends at right angles to the lower edge of the forward wall 151 to provide a bottom support for the leaf spring 155. The upper end of the leaf spring 155 is adapted for engagement with the lower surface of the tape 130 and, together with the wall section 150, provides a clutch means for gripping the tape and allowing movement of the tape only in a forward direction relative to the shuttle 123. To function in this manner, the leaf spring member is preferably slightly longer than the distance between the lower surface of the wall 150 and the upper surface of the shoulder 154, thus causing the leaf spring 155 to be stressed as shown. The tape 130 can be moved forwardly past the leaf spring 155 merely by exerting a pulling force on the forward end of the tape 130 (toward the right as viewed in FIG. 13). Any force tending to move the tape 130 toward the left as viewed in FIG. 13, however, causes the upper edge of the leaf spring 155 to dig into the bottom surface of the tape 130, thus preventing its rearward movement.

The forward end of the shuttle assembly 123 includes a shuttle tongue 119 comprising a relatively flat, thin plate-like member having outer side surfaces and being disposed in a plane generally parallel to the side surfaces of the cartridge housing. The tongue 119 is positioned approximately midway between the side surfaces of the cartridge housing and includes an upwardly extending tab 149, a forwardly disposed beveled edge 117 and a gripping arm engagement portion. As will be described below, the tab 149 extends above the cartridge housing and is adapted for engagement with the spacing ring 109 to control specific spacing between adjacent characters while the beveled edge 117 is adapted for engagement with the stop tab 99 to control general spacing between adjacent characters. The gripping arm engagement portion comprises a pair of parallel side surfaces adapted for engagement by the ends of the gripping arms 114 and 115.

The rearward end of the shuttle assembly 123 includes an arm section 158 extending generally parallel to but offset from the rib section 157. The arm 158 is positioned so that when the shuttle 123 is assembled within the cartridge 16, its outer surface is closely adjacent to the inner surface of the cartridge section 121. The tab 158 includes a post 135 to rotatably support the ribbon roller 134. The roller 134 is retained in rotatable relationship with respect to the post 135 by the web 159 (FIGS. 14 and 17) integrally formed with the housing section 122. As will be described in greater detail below, the post 135 is disposed rearwardly of the post 125 when the shuttle 123 is positioned within the cartridge. As will be seen, this relative position results in pulling ribbon 131 from the spool 145 during rearward movement of the shuttle assembly 123. The ribbon roller 132 is rotatably supported on the post 126 which extends from the inner surface of the housing section 121 and through the elongated opening 156 in the rib section 157. The roller 132 is retained in this position by one side surface of the rib 157 and the inner surface of the housing section 122. It should be noted that both the rollers 134 and 132 are free-spinning rollers whose rotatable movement is unrestricted in any way except by the normal frictional forces that naturally exist between the various moving surfaces.

The ribbon supply spool 145 is rotatably mounted on the post 125 with one end disposed against the inner side surface of the section 121. The spool 145 is retained in this position by the spring member 146. One end of the spring 146 is disposed within an annular recess in the spool 145 while the other end is disposed against the inner side surface of the housing section 122. When the cartridge is assembled, the spring 146 is compressed, thus urging the spool 145 against the inner surface of the section 121 and thus creating additional friction between the spool 145 and the surface of the housing 121 and between the spring 146 and the inner side surface of the housing 122. This additional friction is small enough to still allow the ribbon 131 to be pulled from the spool 145, but large enough to prevent the spool 145 from unwinding during handling of the cartridge, as a result of vibration, etc.

The forward end of the housing section 122 includes a means for guiding the tape 130 and ribbon 131, one above the other, toward printing alignment with respect to the printing station and for reversing the direction of the ribbon 131 after printing so that the used ribbon can be rewound on the rewind spool within the cartridge 16. As shown best in FIGS. 10, 14 and 16, this means includes a forward arm section 160 extending forward of the housing section 122 for supporting a tape guide member 165 and a ribbon guide means comprising the elements 161, 162, 164*a*, 164*b* and 167. The elements 164*a* and 164*b* are angled edges which cause the ribbon 131 exiting from the cartridge to reverse direction and be guided back into the cartridge for rewinding onto the rewind spool 128. Both the edges 164*a* and 164*b* are disposed at equal angles relative to the longitudinal axis of the cartridge 16 or ribbon travel and both are disposed at 45° angles with respect to such axis. Thus, as the ribbon 131 exits from the cartridge 16, it goes around the edge 164*a*, over the top surface 167 connecting the edges 164*a* and 164*b*, then around the edge 164*b* and back into the cartridge. Tab members 161 and 162 extend over a part of the surface 167 in spaced relationship to prevent the ribbon 131 from slipping off the surface 167.

The tape alignment member 165 (FIGS. 10 and 16) includes alignment tabs 166, 166 extending downwardly and inwardly from the main portion of the element 165 to provide an alignment channel for the tape 130 as it moves past the printing station. The member 165 also includes a surface portion which assists in severing the tape 130, when desired, by rotating the font 13 to the appropriate position with the tab 106 (FIGS. 1 and 6) above the blade 48 and causing upward movement of the knife blade 48 against the tape.

The cartridge 16 is adapted for appropriate insertion into the apparatus with the arm 160 and tape-ribbon alignment and guide means extending through the openings 19 and 20 in the frames 11 and 12 (FIG. 1) and into alignment with the printing station as shown in FIG. 4. The cartridge 16 is then retained in fixed relationship to the apparatus during the printing process by appropriate means such as the spring clip 17 engaging the rib member 168 on the side of the cartridge 16 and other supporting and retaining surfaces.

The housing section 121 also includes clutch means for allowing the tape 130 to be pulled from the cartridge but to prevent the movement of the tape 130 back into the cartridge. This means is illustrated best in FIG. 12, and includes the tab portion 141 extending outwardly at right angles from the inner surface of the housing section 121, the guide post 140 and the leaf spring member 142. As shown, the leaf spring 142 is preferably slightly longer than the distance between the lower surface of the tab 141 and the top surface of the supporting shoulder 143. Thus, the spring 142 is stressed forwardly, or to the left as shown in FIG. 12. A plurality of tab portions 144, 144 are provided to support the leaf spring 142 in its proper position. With this construction, the tape 130 can be pulled from the cartridge (toward the left as viewed in FIG. 12), but cannot be pulled or pushed back into the cartridge. If an attempt is made to do so, the upper edge of the leaf spring member 142 will dig into the lower surface of the tape and prevent such movement. Although the preferred embodiment shows this leaf spring clutch assembly connected with a side of the cartridge housing, it can also be associated with the apparatus rather than the cartridge housing.

As will be described below during the discussion of the operation of the present invention, the tape clutch means associated with the housing section 121 in combination with the clutch means associated with the shuttle assembly 123 causes advancement of the printing tape 130 as a result of reciprocal movement of the shuttle 123. This advancement of the tape 130 and consequential rotation of the spools 129 and 128 causes corresponding advancement of the ribbon 131.

Having described the constructional details of the printing apparatus and tape-ribbon cartridge of the present invention, the operational relationship between the font 13, the cartridge 16 and the printing apparatus and the operation of the printing apparatus and the means for advancing and properly aligning and guiding the tape and ribbon in printing alignment with the printing station can be understood as follows.

First of all, the tape-ribbon cartridge 16 is inserted into the apparatus into the printing position as shown in FIG. 4. In this position, the arm 160 and the forward end of the tape and ribbon guide means are inserted through the openings 19 and 20 (FIG. 1) in the frame members 11 and 12 and into alignment with the printing station with the printing tape 130 and ribbon 131 between the upper and lower print pads 85 and 41. During this insertion of the cartridge 16, the shuttle tongue 119 is inserted between the gripping ends of the jaws 114 and 115 as illustrated in FIGS. 7 and 8. The cartridge 16 is retained in this inserted position relative to the apparatus frame by appropriate support retaining means such as the rib 168 and spring clip 17. After the cartridge has been inserted, the apparatus is normally run through a print cycle to insure engagement between the tongue 119 and the jaws 114 and 115. The font element 13 is then inserted by placing a portion of its peripheral edge beneath the upper print pad 85 and above the cartridge arm 160 and mounting the central opening 108 onto the post 110 for free spinning rotation. When the cartridge 16 and the font 13 are inserted, the printing process is ready to begin.

The first step in the printing process is to rotate the font 13 to position the character 105 to be lettered into approximate printing alignment with the print station. In the preferred embodiment, the printing station is that area between the lower printing pad 41 and the upper pad 85. After the font 13 has been appropriately positioned, the print button 79 is depressed. This movement causes downward pivotal movement of the print lever 75 with respect to the pivot 76 and outward pivotal movement of the arm 69 about the pivot 62 by virtue of engagement between the tab member 78 on the end of the print lever and the arm 69. This outward pivotal movement of the arm 69, and thus the brake jaw 56, about the pivot 62 results in corresponding outward pivotal movement of the brake jaw 58 about its pivot 62 because of engagement between the members 59 and 60. Such outward pivotal movement of the jaws 56 and 58 releases the braking forces being exerted on the Nylon disc 55.

Outward movement of the arm 69 also causes the switch button 73 to be released into an "on" position, thus causing an actuation of the motor 15. Actuation of the motor 15 causes the same to run through a single cycle which rotates the gear 51 enough times to rotate the large gear 40 one complete revolution. During this revolution, the outer surface of the cam 68 (FIG. 3) engages the brake jaw tab 66 to maintain the jaws 56 and 58 in a non-braking position during the print cycle. Also during this revolution of the gear 40, the eccentric pin 39 causes translational movement of the crank link 30 and thus upward pivotal movement of the print bar assembly 10 about the pivot 25 as a result of the toggle elements 29 and 31. Movement of the print bar assembly 10 between its lower position and its upper position is shown best in FIG. 2 with the lower position shown in solid lines and the upper position shown in broken lines.

Upward movement of the print bar assembly 10 results in a printing force being generated between the upper and lower print pads 85 and 41, thereby causing an image of the raised character 105 to be transferred from the printing ribbon 131 to the printing tape 130. Just prior to exertion of the printing force, the font alignment elements 45, 45 (FIGS. 1 and 4) engage the font alignment tab 113 on the underside of the font 13 to finally align the font into printing position. If the font 13 is not exactly manually aligned prior to commencement of a print cycle, the beveled edges of the elements 45, 45 will assure exact alignment. It should be noted that the amount of printing force created by the print bar assembly 10 can be adjusted by changing the longitudinal position of the upper print pad assembly 80. Because the upper print pad 85 is thicker at one end than at the other, movement of the assembly 80 toward the left as viewed in FIG. 2 will result in a greater vertical distance between the print pad 41 and the lower surface of the print pad 85 and thus a small print force. Conversely, if the assembly 80 is moved toward the right as viewed in FIG. 2, the portion of the print pad 85 in alignment with the printing station will be thicker, thus resulting in a smaller vertical distance between the print pad 41 and the lower surface of the print pad 85 and thus the generation of a larger print force. Such adjustment of the print force may be necessary or desirable when changing to printing fonts with larger or smaller typeface.

As the printing cycle is commenced and the print bar assembly 10 is in its lower position, the gripping arms 114 and 115 (FIGS. 3, 4 and 8) and the shuttle assembly 123 is in a forward or advanced position. The exact location of this forward position is determined by engagement between the beveled edge 117 of the shuttle tongue 119 and the tab 99 of the spacing arm 92. As can be seen, the vertical position of the tab 99 controls the extent to which the shuttle tongue 119 can be moved in a forward direction. The higher the tab 99, the greater the allowed forward movement, while the lower the tab 99, the less the allowed forward movement. As previously described, the vertical position of the tab 99 is controlled by rotation of the thumbwheel 100 (FIGS. 1 and 3) which pivots the spacing arm 92 about the contact point between the tab 102 and the recessed area 101. The purpose of the spacing arm 92 and its related structure is to control the general spacing between adjacent characters.

As the print bar assembly 10 moves upwardly, the gripping ends of the shuttle tongue gripping jaws 114 and 115 (FIGS. 4 and 8) move rearwardly (toward the right as viewed in FIG. 4) as the result of upward movement of the wire link 111 and pivotal movement of the link 116 about the pivot 118. This rearward movement results in corresponding rearward movement of the shuttle tongue 119 until the indexing tab 149 engages the outer circumferential surface of the spacing ring 109. When this occurs, movement of the shuttle tongue 119 stops and rearward movement of the gripping arms 114 and 115 continues until the print bar assembly 10 has reached its uppermost position.

After the print bar assembly 10 has reached its uppermost position, it begins downward pivotal movement about the pivot 25. This downward movement causes corresponding forward movement of the gripping ends of the arms 114 and 115 and corresponding forward movement of the shuttle tongue 119 toward a forward position. The location of this forward position is again determined by engagement between the angled indexing edge 117 on the shuttle tongue 119 and the tab 99. When engagement is made, forward movement of the shuttle tongue 119 stops while forward movement of the gripping arms 114 and 115 continues until the print bar assembly 10 reaches its lowermost position. Continued forward and rearward movement of the gripping arms 114 and 115 after movement of the shuttle tongue 119 has stopped results in the gripping ends sliding with respect to the side surfaces of the shuttle tongue 119. It should be noted that the connection between the wire link 111 and the assembly 10 permits limited downward movement of the printing bar assembly 10 before imparting such movement to the wire 111. This insures that the printing force is totally released before movement of the tongue 119 and tape 130.

Following completion of one printing cycle, the font element 13 is rotated to approximately align the next character to be printed. The print cycle is then again actuated by depressing the print button 79. Again, as the print bar assembly 10 is moved upwardly, the shuttle tongue 119 is moved rearwardly until the tab 149 engages the spacing ring 109 at which time rearward movement stops. Then during downward movement of the assembly 10, the tongue 119 is moved forwardly. Thus, each printing cycle results in rearward and forward reciprocal movement of the shuttle tongue 119 and thus the shuttle assembly 123 (FIG. 10).

As described best with respect to FIG. 10 and the other figures showing various features of the tape-ribbon cartridge, reciprocal forward and rearward movement of the shuttle assembly 123 results in advancement of the tape and ribbon toward the printing station. First of all, during rearward movement of the shuttle assembly 123 as the print bar 10 is moved upwardly, the printing tape 130 is prevented from moving rearwardly relative to the housing section 121 because of the leaf spring clutch assembly (FIG. 12) associated with the housing section 121. As previously described, the leaf spring 142 in combination with the various other clutch elements preclude rearward movement of the tape 130 relative to the section 121 and thus the printing cartridge. Because the tape 130 remains stationary during rearward movement of the shuttle 123, the tape 130 is pulled past the shuttle leaf spring clutch assembly (FIG. 13) as the shuttle is moved rearwardly.

As the shuttle assembly 123 beings to move forward, the bottom of the tape 130 is gripped by the upper edge of the leaf spring 155 (FIG. 13), thus causing the tape 130 to move forwardly with the shuttle assembly 123. This force causing forward movement of the tape 130 is sufficient to also cause the tape 130 to move forwardly past the leaf spring 142 (FIG. 12) relative to the housing section 121. Thus, as can be seen, reciprocal back and forth movement of the shuttle assembly results in advancement of the tape 130 during each forward stroke. As can also be seen, the amount of advancement of the tape 130 is dependent upon both the extent to which the shuttle assembly 123 is allowed to move rearwardly during its rearward stroke and forwardly during its forward stroke. Clearly, the greater rearward movement, the greater the tape advance will be when the assembly 123 is moved in a forward direction. As discussed previously, this allowable rearward and forward movement is controlled by the spacing ring 109 and the tab 99, respectively.

As the tape 130 is advanced from the cartridge, it is pulled from the spool 129, thus causing rotation of the spool 129 and corresponding rotation of the connected ribbon rewind spool 128. Because the spool 128 is the rewind spool for the ribbon 131, rotation of the spool 128 causes the ribbon 131 to be pulled through the ribbon guide system as the tape 130 is advanced. During rearward movement of the shuttle assembly 123, the ribbon spool 128 and ribbon roller 132 remain stationary with respect to the cartridge housing; however, the ribbon roller 134, journalled with respect to a portion of the shuttle assembly 123, moves rearwardly with the assembly. This rearward movement of the roller 134 causes printing ribbon 131 to be pulled from the ribbon supply spool 145 resulting in a supply of slack ribbon. Then, during forward movement of the shuttle assembly 123, the slack ribbon which has been pulled from the spool 145 during the rearward movement, is pulled through the ribbon guide system as a result of rotation of the rewind spool 128. The pulling of ribbon 131 from the spool 145 is accomplished because the post 135 supporting the roller 134 is disposed rearwardly of the spool 145. Because of the force exerted by the spring member 146 on the spool 145, it is important that the ribbon 131 be pulled from the spool 145 during the rearward movement of the shuttle 123 as described above. This provides a relatively free supply of slack ribbon to be pulled through the guide system during forward movement of the shuttle. If the system did not provide for pulling ribbon from the spool 145 during rearward movement of a shuttle, the frictional forces on the ribbon 131 through the guide system together with the forces of the spring 146 tending to resist free spinning of the spool 145, could be significant enough to preclude advancement of the ribbon.

Although the description of the preferred embodiment of the present invention has been quite specific, it is contemplated that various modifications and changes could be made without deviating from the spirit of the present invention. Thus, it is contemplated that the scope of the present invention be dictated by the appended claims rather than by the description of the preferred embodiment.

We claim:

1. A cartridge for supplying printing tape and ribbon to a printing apparatus, said cartridge comprising:

a cartridge housing;

a spool of printing tape rotatably supported within said housing;

a supply of printing ribbon;

advancing means for advancing said printing tape and printing ribbon toward printing alignment with respect to the printing apparatus;

a ribbon rewind spool;

means for causing rotation of said ribbon rewind spool in response to the rotation of said spool of printing tape; and ribbon guide means for guiding said printing ribbon from said printing ribbon supply, toward printing alignment with respect to the printing apparatus and onto said ribbon rewind spool.

2. The cartridge of claim 1 wherein said supply of printing ribbon includes a spool of printing ribbon rotatably supported within said housing.

3. The cartridge of claim 1 wherein said ribbon rewind spool and said spool of printing tape rotate together on a common axis.

4. The cartridge of claim 3 wherein said ribbon rewind spool and said spool of printing tape are in side-by-side relationship on a common axis.

5. The cartridge of claim 1 wherein said advancing means includes a shuttle means reciprocally movable between forward and rearward positions relative to said housing.

6. The cartridge of claim 5 wherein said advancing means includes first clutch means for preventing rearward movement of said printing tape relative to said housing and second clutch means for preventing rearward movement of said printing tape relative to said shuttle means.

7. The cartridge of claim 6 wherein said first clutch means includes a first leaf spring member connected with said housing and having an edge engaging a surface of said printing tape and said second clutch means includes a second leaf spring member connected with said shuttle means and having an edge engaging a surface of said printing tape.

8. The cartridge of claim 1 including tape guide means for guiding said printing tape from said printing tape supply toward printing alignment with respect to the printing apparatus.

9. The cartridge of claim 8 wherein said ribbon guide means and said tape guide means said printing ribbon and said printing tape, one above the other, toward printing alignment with respect to the printing apparatus.

10. The cartridge of claim 9 wherein said tape guide means includes a metal clip having a pair of inwardly facing tabs.

11. The cartridge of claim 9 wherein said ribbon guide means includes ribbon direction changing means for changing the direction of movement of said printing ribbon.

12. The cartridge of claim 11 wherein said tape guide means and said ribbon direction changing means are mounted on an arm positioned forward of said cartridge housing.

13. The cartridge of claim 12 including a rotatable roller for guiding said printing ribbon from said direction changing means to said ribbon rewind spool.

14. The cartridge of claim 5 wherein said shuttle means includes a ribbon guide and advancement element movable with said shuttle means and reciprocally movable relative to said printing ribbon supply.

15. The cartridge of claim 14 wherein said ribbon guide element is positioned upwardly and rearwardly relative to said supply of printing ribbon.

16. The cartridge of claim 15 wherein said ribbon guide element comprises a roller rotatably supported by and movable with a portion of said shuttle means.

17. The cartridge of claim 16 wherein said shuttle means includes a generally flat ribbon supporting surface disposed at generally right angles relative to the side walls of said cartridge housing.

18. The cartridge of claim 17 wherein said supply of printing ribbon includes a spool of printing ribbon rotatably mounted between the side walls of said housing and means for resisting the free spinning rotation of said spool of printing ribbon.

19. The cartridge of claim 5 including means for guiding said shuttle means in reciprocal movement including a pair of guide rails connected with the side walls of said housing.

20. The cartridge of claim 5 wherein said shuttle means includes an indexing tab extending above the top of said housing for limiting the rearward movement of said shuttle means.

21. The cartridge of claim 5 wherein said shuttle means includes an indexing edge disposed at an angle relative to the direction of reciprocal movement of said shuttle means for limiting the forward movement of said shuttle means.

22. The cartridge of claim 5 wherein said shuttle means includes a shuttle tongue positioned forward of said printing tape and printing ribbon supply and comprising a pair of outer side surfaces, said outer side surfaces being disposed generally parallel to the side walls of said housing.

23. The cartridge of claim 1 including a font rotation post connected with the top of said housing and extending generally perpendicular to the direction of reciprocal movement of said shuttle means.

24. A cartridge for supplying printing tape and ribbon to a printing apparatus, said cartridge comprising:

a cartridge housing;

a supply of printing tape;

a supply of printing ribbon;

advancing means for advancing said printing tape and printing ribbon toward printing alignment with respect to the printing apparatus, said advancing means being disposed within said cartridge housing and including a shuttle means reciprocally movable between forward and rearward positions relative to said cartridge housing; and first clutch means connected with said cartridge housing for permitting forward and for preventing rearward movement of said printing tape relative to said housing and second clutch means connected with said shuttle means for permitting forward and for preventing rearward movement of said printing tape relative to said shuttle means.

25. The cartridge of claim 24 wherein said first clutch means includes a first leaf spring member connected with said housing and having an edge engaging a surface of said printing tape and said second clutch means includes a second leaf spring member connected with said shuttle means and having an edge engaging a surface of said printing tape.

26. The cartridge of claim 24 wherein said shuttle means includes an indexing tab extending above the top of said housing for limiting the rearward movement of said shuttle means.

27. The cartridge of claim 26 wherein said shuttle means includes an indexing edge disposed at an angle relative to the direction of reciprocal movement of said shuttle means for limiting the forward movement of said shuttle means.

28. The cartridge of claim 27 wherein said shuttle means includes a shuttle tongue positioned forward of said printing tape and printing ribbon supply and comprising a pair of outer side surfaces, said outer side surfaces being disposed generally parallel to the side walls of said housing.

29. The cartridge of claim 24 including a font rotation post connected with the top of said housing and extending generally perpendicular to the direction of reciprocal movement of said shuttle means.

30. A printing apparatus comprising:

a print station;

a printing cartridge including a cartridge housing, a supply of printing tape and printing ribbon and shuttle means being disposed within said cartridge housing and reciprocally movable relative to said cartridge housing for advancing said printing tape and printing ribbon into printing alignment at said print station;

means for retaining said printing cartridge in a fixed position relative to said print station;

a rotatable font having a plurality of raised characters about its peripheral edge; and means for generating a print force at said print station.

31. The printing apparatus of claim 30 wherein said means for generating print force at said print station includes a print bar assembly pivotable at one end to the printing apparatus frame and means for pivoting said print bar assembly comprising a fixed link having one end pivotally connected with the printing apparatus frame, a movable link having one end pivotally connected with the other end of said fixed link and the other end of said movable link pivotally connected with the other end of said print bar assembly, a crank link having one end pivotally connected with said fixed link at a point between its ends and means for moving the other end of said crank link in generally translational movement.

32. The printing apparatus of claim 30 including an upper print pad assembly, said upper print pad assembly being movable longitudinally with respect to said print station and including an upper print pad of varying thickness.

33. The printing apparatus of claim 32 including means for selectively moving said upper print pad assembly into one of a plurality of selectable longitudinal positions with respect to said print station.

34. The printing apparatus of claim 30 including a stop tab for limiting the forward movement of said shuttle means.

35. The printing apparatus of claim 34 wherein said rotatable font includes a spacing surface adapted for limiting the rearward movement of said shuttle means.

36. The printing apparatus of claim 35 wherein said shuttle means includes a beveled indexing surface adapted for engagement with said stop tab for limiting the forward movement of said shuttle means and an indexing tab adapted for engagement with said spacing surface for limiting the rearward movement of said shuttle means.

37. The printing apparatus of claim 36 including means for adjusting the position of said stop tab.

38. The printing apparatus of claim 30 wherein said shuttle means includes a shuttle tongue and said printing apparatus includes a pair of gripping arms adapted for engagement with side surfaces of said shuttle tongue.

39. A printing apparatus comprising:

a print station;

a printing cartridge including a cartridge housing, a supply of printing tape and printing ribbon and shuttle means reciprocally movable relative to said cartridge housing for advancing said printing tape and printing ribbon into printing alignment at said print station;

a shuttle tongue;

a pair of gripping arms adapted for engagement with side surfaces of said shuttle tongue wherein said gripping arm including gripping ends adapted for gripping the side surfaces of said shuttle tongue;

a rotatable font having a plurality of raised characters about its peripheral edge; and means for generating a print force at said print station.

40. The printing apparatus of claim 39 wherein said means for generating a print force includes a print bar wherein said printing apparatus further includes means for pivotally moving said gripping arms in response to movement of said print bar.

41. A cartridge for supplying printing tape and ribbon to a printing apparatus, said cartridge comprising:

a cartridge housing;

a supply of printing tape;

a supply of printing ribbon;

advancing means for advancing said printing tape and printing ribbon toward printing alignment with respect to the printing apparatus including a shuttle means disposed within said cartridge housing and reciprocally movable between forward and rearward positions relative to said housing;

an indexing tab included in said shuttle means and extending above the top of said housing for limiting the rearward movement of said shuttle means; and ribbon guide means for guiding said printing ribbon from said printing ribbon supply, toward printing alignment with respect to the printing apparatus.

42. A cartridge for supplying printing tape and ribbon to a printing apparatus, said cartridge comprising:

a cartridge housing;

a supply of printing tape;

a supply of printing ribbon;

advancing means for advancing said printing tape and printing ribbon toward printing alignment with respect to the printing apparatus including a shuttle means disposed within said cartridge housing and reciprocally movable between forward and rearward positions relative to said housing;

a shuttle tongue included in said shuttle means positioned forward of said printing tape and printing ribbon supply and comprising a pair of outer side surfaces, said outer side surfaces being disposed generally parallel to the side walls of said housing; and ribbon guide means for guiding said printing ribbon from said printing ribbon supply, toward printing alignment with respect to the printing apparatus.

43. A cartridge for supplying printing tape and ribbon to a printing apparatus, said cartridge comprising:

a cartridge housing;

a supply of printing tape;

a supply of printing ribbon;

advancing means for advancing said printing tape and printing ribbon toward printing alignment with respect to the printing apparatus including a shuttle means disposed within said cartridge housing and reciprocally movable between forward and rearward positions relative to said housing;

ribbon guide means for guiding said printing ribbon from said printing ribbon supply, toward printing alignment with respect to the printing apparatus; and a font rotation post integrally connected with the top of said housing and extending generally perpendicular to the direction of reciprocal movement of said shuttle means.

* * * * *